US008235321B2

(12) United States Patent
Chen

(10) Patent No.: US 8,235,321 B2
(45) **Date of Patent: *Aug. 7, 2012**

(54) STEPLESS FASTENING DEVICE

(76) Inventor: Chin-Chu Chen, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/273,255

(22) Filed: Oct. 14, 2011

(65) Prior Publication Data

US 2012/0023717 A1 Feb. 2, 2012

Related U.S. Application Data

(63) Continuation-in-part of application No. 12/725,432, filed on Mar. 16, 2010.

(51) Int. Cl.
*B65H 75/48* (2006.01)
*A43C 11/00* (2006.01)

(52) U.S. Cl. ..... 242/378.1; 24/68 SK

(58) Field of Classification Search .... 242/378.1–378.3; 24/713.2, 68 SK

See application file for complete search history.

(56) References Cited

U.S. PATENT DOCUMENTS 4,633,599 A * 1/1987 Morell et al. ..... 242/388.1
4,660,300 A * 4/1987 Morell et al. ..... 36/118.1
7,367,522 B2 * 5/2008 Chen ..... 242/378.1
2011/0191992 A1 * 8/2011 Chen ..... 24/713.2

* cited by examiner

*Primary Examiner* — Sang Kim

(57) ABSTRACT

A stepless fastening device includes a cap having a driving gear and multiple one-direction teeth connected to an underside thereof. The driving gear is engaged with a spool located in the base so that the strip or shoelace is wrapped to the spool. An operation unit is located beneath the cap and rotatable in a first direction for fastening and a second direction for loosening the strip or shoelace. An operation ring of the operation unit is connected to the underside of the cap and pushes an activation ring away from the cap when the operation ring is rotated in the second direction. An engaging member includes inclined teeth and pushed by the activation ring so that the inclined teeth are disengaged from the one-direction teeth of the cap when the operation ring is rotated in the second direction.

6 Claims, 8 Drawing Sheets

STEPLESS FASTENING DEVICE

CROSS-REFERENCE TO RELATED APPLICATION

This application is a Continuation-In-Part application of Ser. No. 12/725,432, filed 16 Mar. 2010, and entitled "STEPLESS FASTENING DEVICE", now pending.

BACKGROUND OF THE INVENTION

1. Field of the Invention

The present invention relates to a fastening device, and more particularly, to a stepless fastening device which fastens a strip or shoelace in one direction and looses in the opposite direction.

2. Description of Related Art

A conventional fastening device is shown in FIGS. 7 to 9, and generally includes a cap 4 which is rotated to one direction to fasten the strip of shoelace. The cap 4 includes inner gear 41 and outer gear 42, and both of which are rotated simultaneously when the cap 4 is rotated. The inner gear 41 is engaged with the gear 51 on the spool 5 such that the strip of the shoelace is wrapped around the spool 5 and received in the accommodation space 52 of the spool 5. The outer gear 42 is engaged with the ratchet teeth 61 on the ratchet ring 6 to ensure that the spool can only be rotated in one direction and to prevent the strip of the shoelace from loosened. When rotating the cap 4, the ratchet ring 6 is moved up and down by the flexible legs 62 connected to the underside of the ratchet ring 6 such that the ratchet teeth 61 is engaged with the outer gear 42 to ensure the rotation is stable and smooth. When loosening the strip or the shoelace, the cap 4 is pulled upward so that the shaft 7 in the hole of the base 8 is moved upward a distance while the positioning member 83 in the pivotal part 82 is engaged with the lower groove 71 of the shaft 7 to avoid the shaft 7 from being pulled out from the pivot part 82. In this status, the inner gear 41 is disengaged from the gear 51 on the spool 5, and the outer gear 42 is disengaged from the ratchet teeth 61 of the ratchet ring 6, so that the cap 4 is rotated without driving the spool 5. The strip or the shoelace is then able to be loosened.

However, when the strip or the shoelace is too much tightened, the user has to pull the cap 4 upward to disengage the outer gear 42 from the ratchet teeth 61 of the ratchet ring 6 so as to loose the strip or the shoelace. Once the action is done, the user has to re-tighten the strip or the shoelace again and do that carefully to avoid from tighten the strip or the shoelace too much. In other words, there lacks a way to loose the strip or the shoelace a little bit without the need to pull the cap upward.

The present invention intends to provide a stepless fastening device which allows the users to rotate the cap in opposite direction to steplessly loosen the strip or shoelace a little bit without the need to pull the cap upward.

SUMMARY OF THE INVENTION

The present invention relates to a stepless fastening device includes a cap having a driving gear and multiple one-direction teeth connected to an underside thereof. An operation unit is located beneath the cap and rotatable in a first direction for fastening and a second direction for loosening. The operation unit comprises an operation ring, an activation ring and an engaging member. The operation ring is connected to the underside of the cap and pushes the activation ring away from the cap when the operation ring is rotated in the second direction. The engaging member includes inclined teeth and pushed by the activation ring so that the inclined teeth are disengaged from the one-direction teeth of the cap. A base has a spool which has teeth engaged with the driving gear of the cap.

The primary object of the present invention is to provide a fastening device that allows the strip or the shoelace to be loosened a little bit after it is fastened, by reversely rotating the operation ring.

The present invention will become more obvious from the following description when taken in connection with the accompanying drawings which show, for purposes of illustration only, a preferred embodiment in accordance with the present invention.

DETAILED DESCRIPTION OF THE INVENTION

Figure 1:
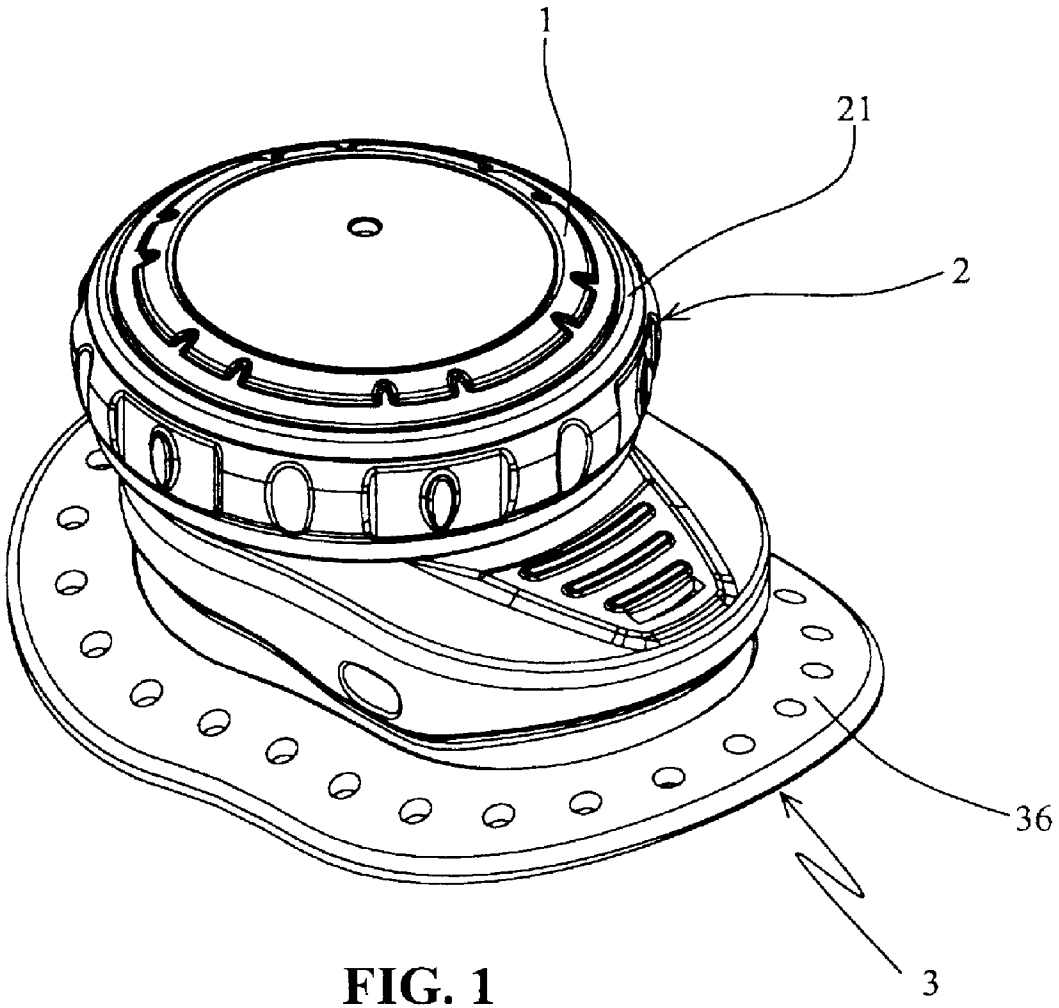
FIG. 1 is a perspective view to show the stepless fastening device of the present invention.
Figure 2:
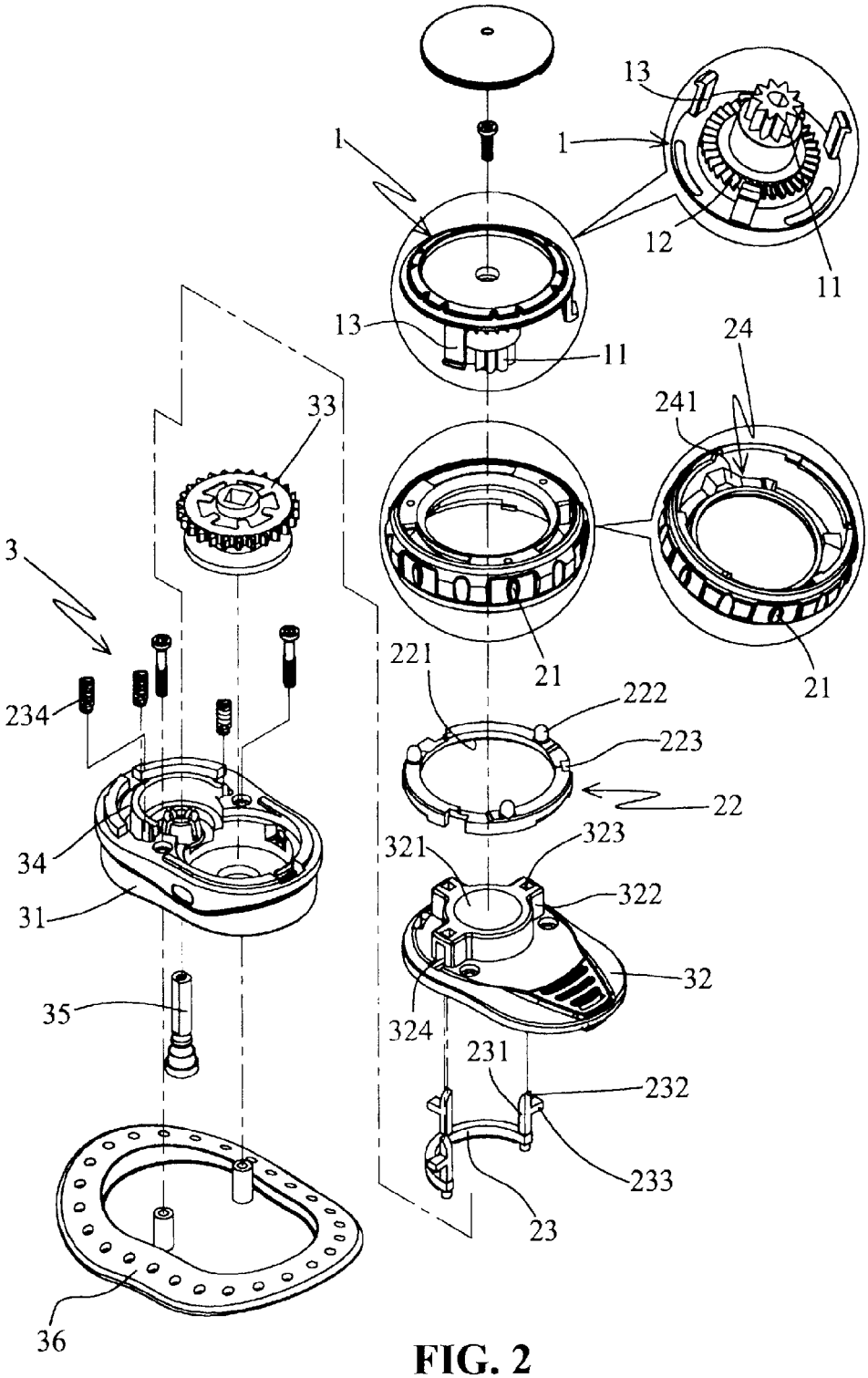
FIG. 2 is an exploded view to show the stepless fastening device of the present invention.
Figure 3:
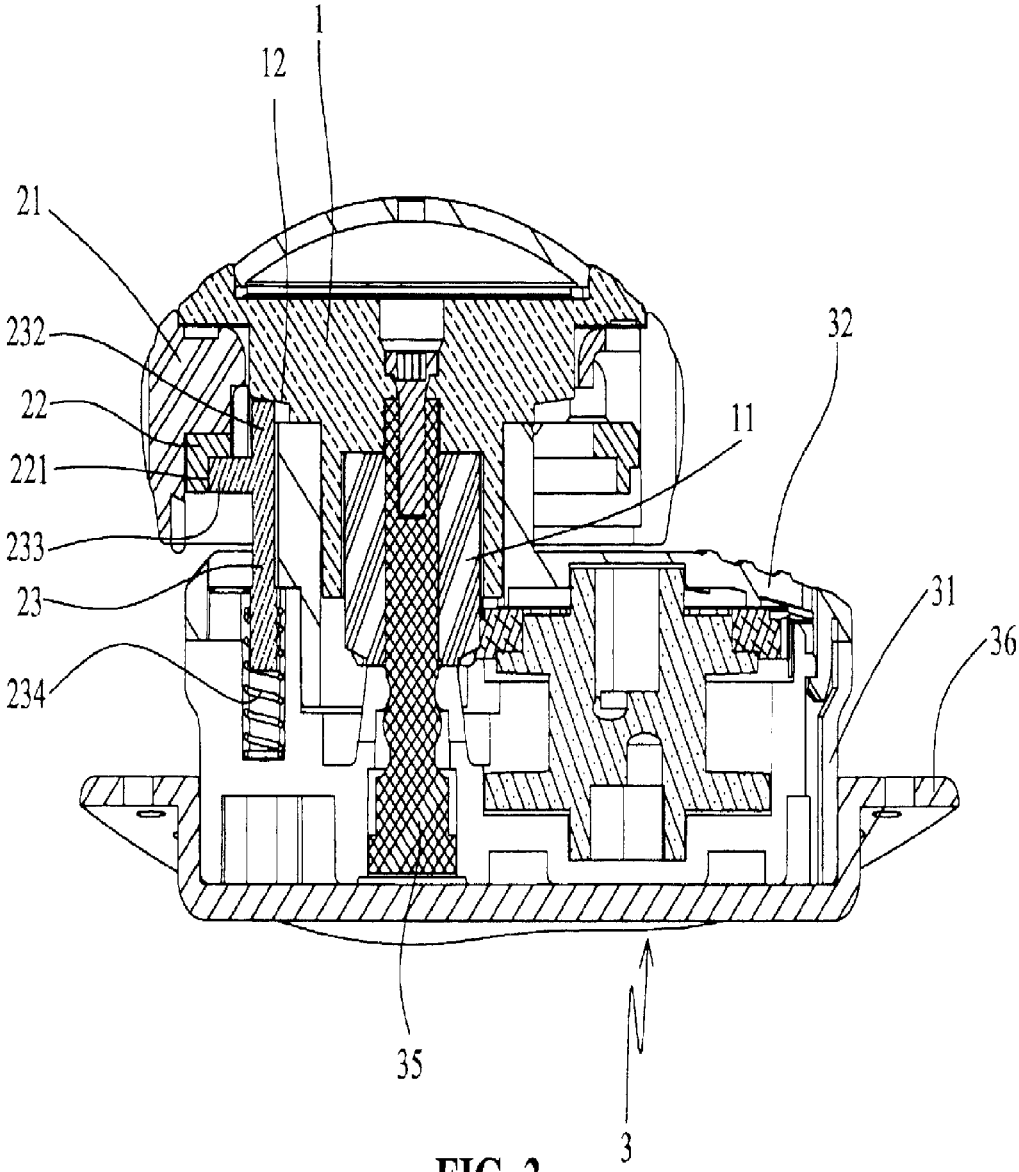
FIG. 3 is a cross sectional view to show the stepless fastening device of the present invention.
Figure 4:
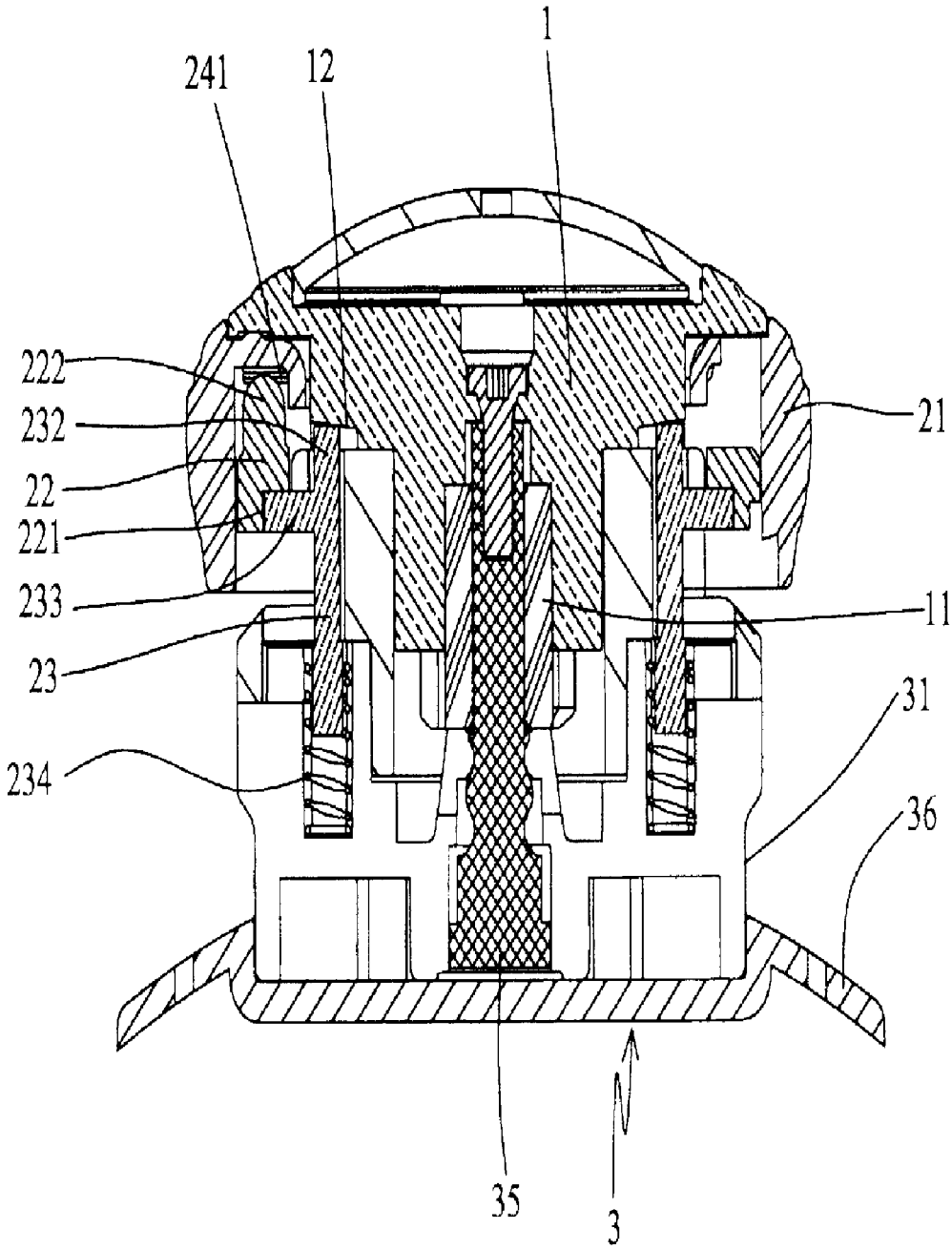
FIG. 4 is another cross sectional view to show the stepless fastening device of the present invention.

Referring to FIGS. 1 to 4, the stepless fastening device of the present invention is usually used to fasten the shoelace of shoes, and can be also used to close an opening of an object such as a bag. The stepless fastening device comprises a cap 1 having a driving gear 11 connected to an underside thereof and multiple one-direction teeth 12 are located around the driving gear 11. A plurality of arms 13 extend from an outer periphery of the cap 1.

An operation unit 2 is located beneath the cap 1 and rotatable in a first direction for fastening and a second direction for loosening The operation unit 2 comprising an operation ring 21, an activation ring 22 and an engaging member 23. The operation ring 21 is connected to the underside of the cap 1 and includes multiple pressing blocks 24 located on an underside thereof. Each pressing block 24 includes an inclined surface 241. The operation ring 21 of the operation unit 2 is mounted to the arms 13.

The activation ring 22 includes a skirt 221, multiple notches 223 and multiple protrusions 222. The skirt 221 extends from an underside of the activation ring 22 and the multiple notches 223 are defined in an outer periphery of the activation ring 22. The protrusions 222 extend from a top of the activation ring 22 and contact the inclined surfaces 241 of the pressing blocks 24. The activation ring 22 is located in the operation ring 21 and the arms 13 of the cap 1 extend through the operation ring 21 and the notches 223 of the activation ring 22.

The engaging member 23 includes multiple posts 231 and each post 231 has an inclined tooth 232 on a top thereof. The inclined teeth 232 are engaged with the one-direction teeth 12 of the cap 1. Each of the posts 231 includes a snap piece 233 which extends perpendicularly from the post 231. The engaging member 23 are biased by springs 234 which are located in the base 3 and mounted to respective lower ends of the posts 231. The springs 234 push the inclined teeth 232 to be engaged with the one-direction teeth 12. The skirt 221 of the activation ring 22 is engaged with the snap pieces 233.

A base 3 includes a top part 32, a bottom part 31 and a connection part 36, wherein the top part 32 is connected to the bottom part 31 which is connected to the connection part 36. The connection part 36 is fixed to an object such as a shoe. A spool 33 is received in a first chamber of the bottom part 31 and has teeth is engaged with the driving gear 11 of the cap 1. A second chamber of the bottom part 31 includes a groove 34 with which the engaging member 23 is engaged. A shaft 35 extends from the underside of the bottom part 31 and through a positioning tube located in the second chamber. The top part 32 includes a hole 321 defined therethrough and three wings 322 are located on a top of the top part 32. Each wing 322 includes a passage 323 through which the inclined tooth 232 extends and each further includes a snap hole 324 defined in one side thereof so that the snap piece 233 is engaged.

When assembling, the springs 234 are mounted to the lower ends of the posts 231 of the engaging member 23, and all of these are received in the groove 34 of the bottom part 31. The top part 32 is connected to the bottom part 31 to allow the inclined teeth 232 to extend through the passages 323, and the snap pieces 233 to be engaged with the snap holes 324. The skirt 221 of the activation ring 22 is engaged with the snap pieces 233. The operation ring 21 is mounted to the activation ring 22 and the inclined surfaces 241 of the pressing blocks 24 of the operation ring 21 press onto the protrusions 222 of the activation ring 22. The arms 13 extend through the operation ring 21, the notches 223 of the activation ring 22, and the driving gear 11 is mounted to the shaft 35 via the hole 321 of the top part 32. The driving gear 11 is engaged with the teeth of the spool 33. The one-direction teeth 12 of the cap 1 are engaged with the inclined teeth 232 of the engaging member 23. The bottom part 31 is then connected to the connection part 36 which is fixed to the object. If the fastening device is damaged, only the fastening device should be replaced by removing the fastening device from the connection part 36.

Figure 5:
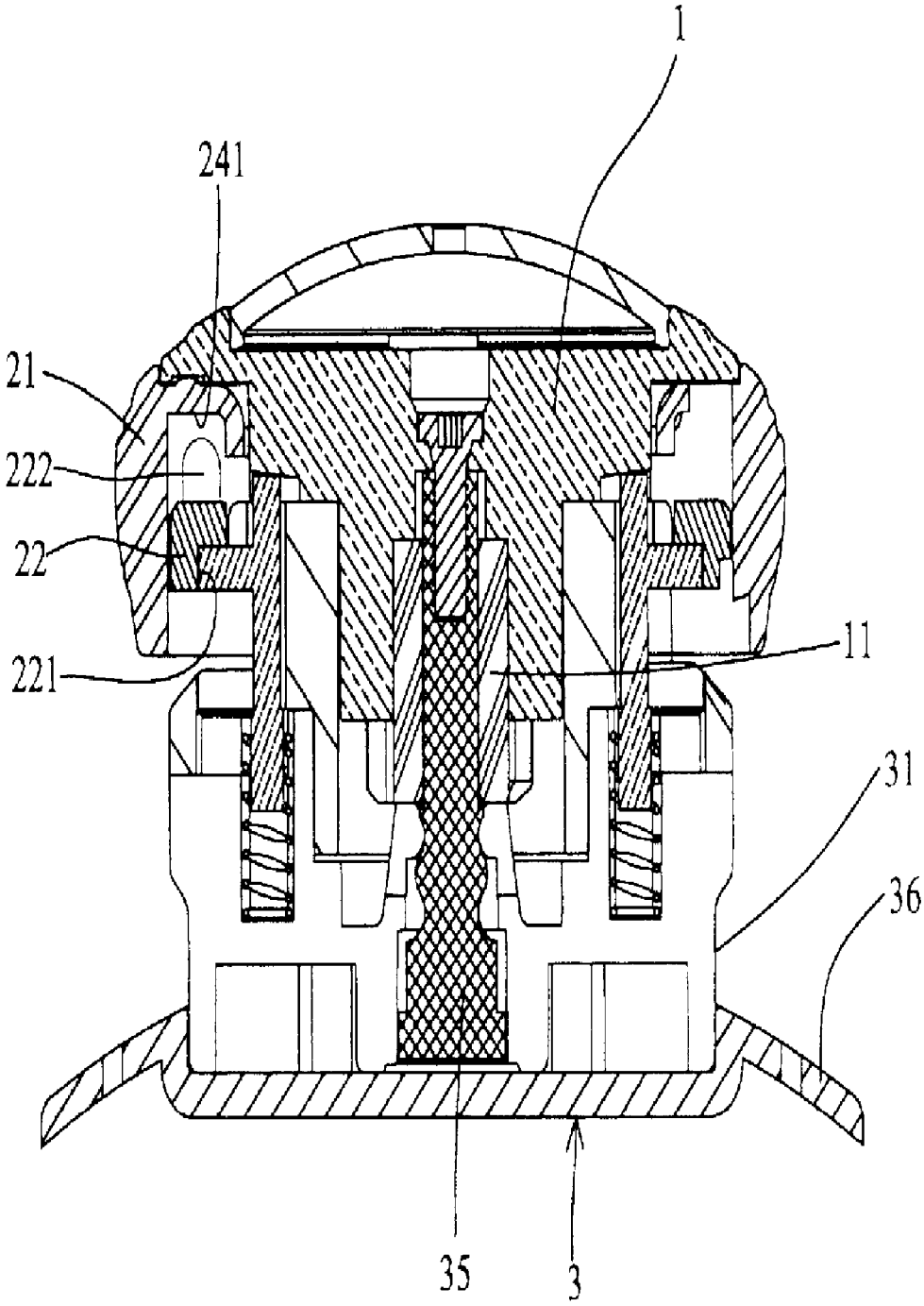
FIG. 5 is yet another cross sectional view to show the stepless fastening device of the present invention.
Figure 6:
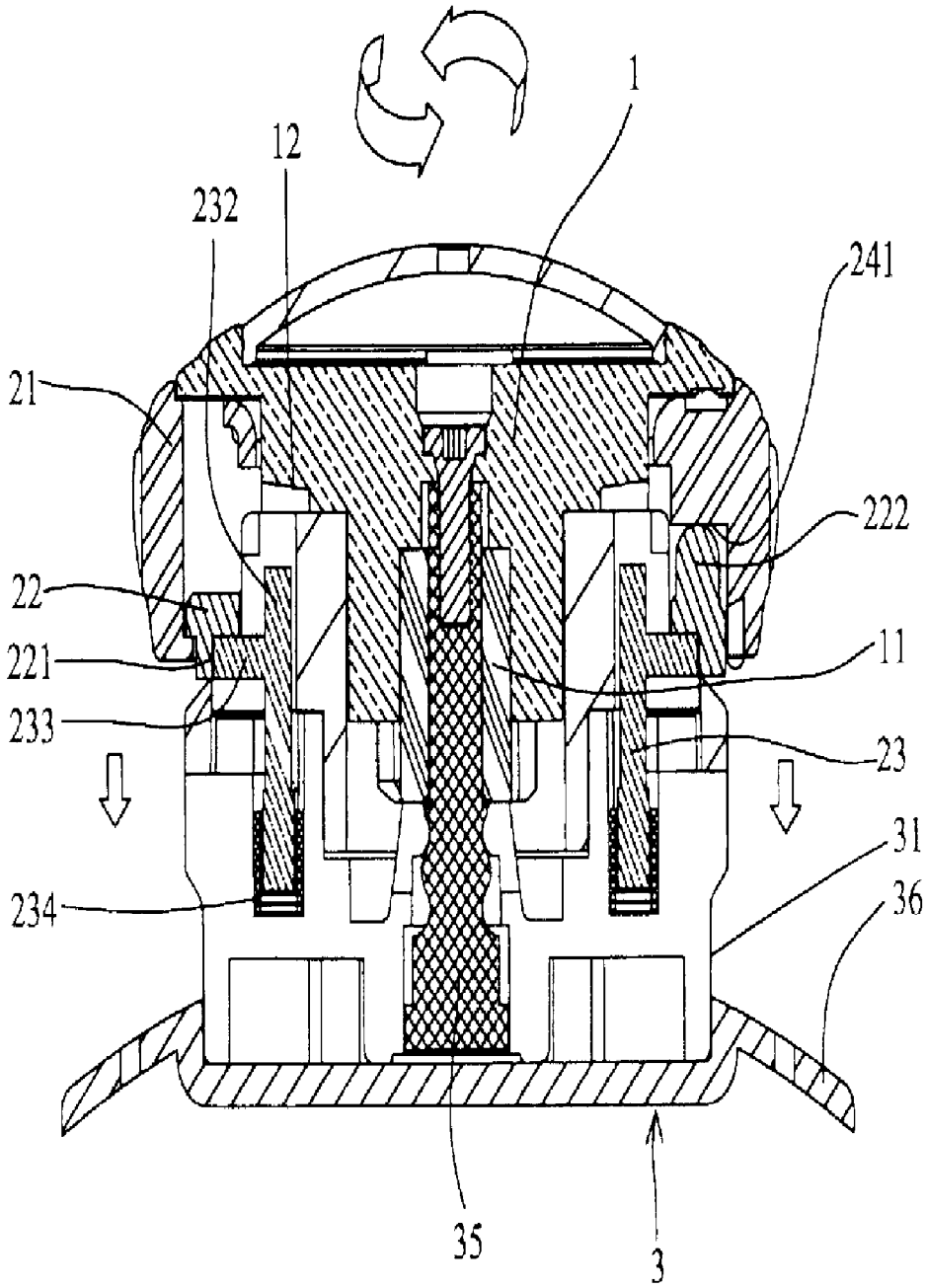
FIG. 6 shows that the operation ring is rotated in the second direction.
Figure 7:
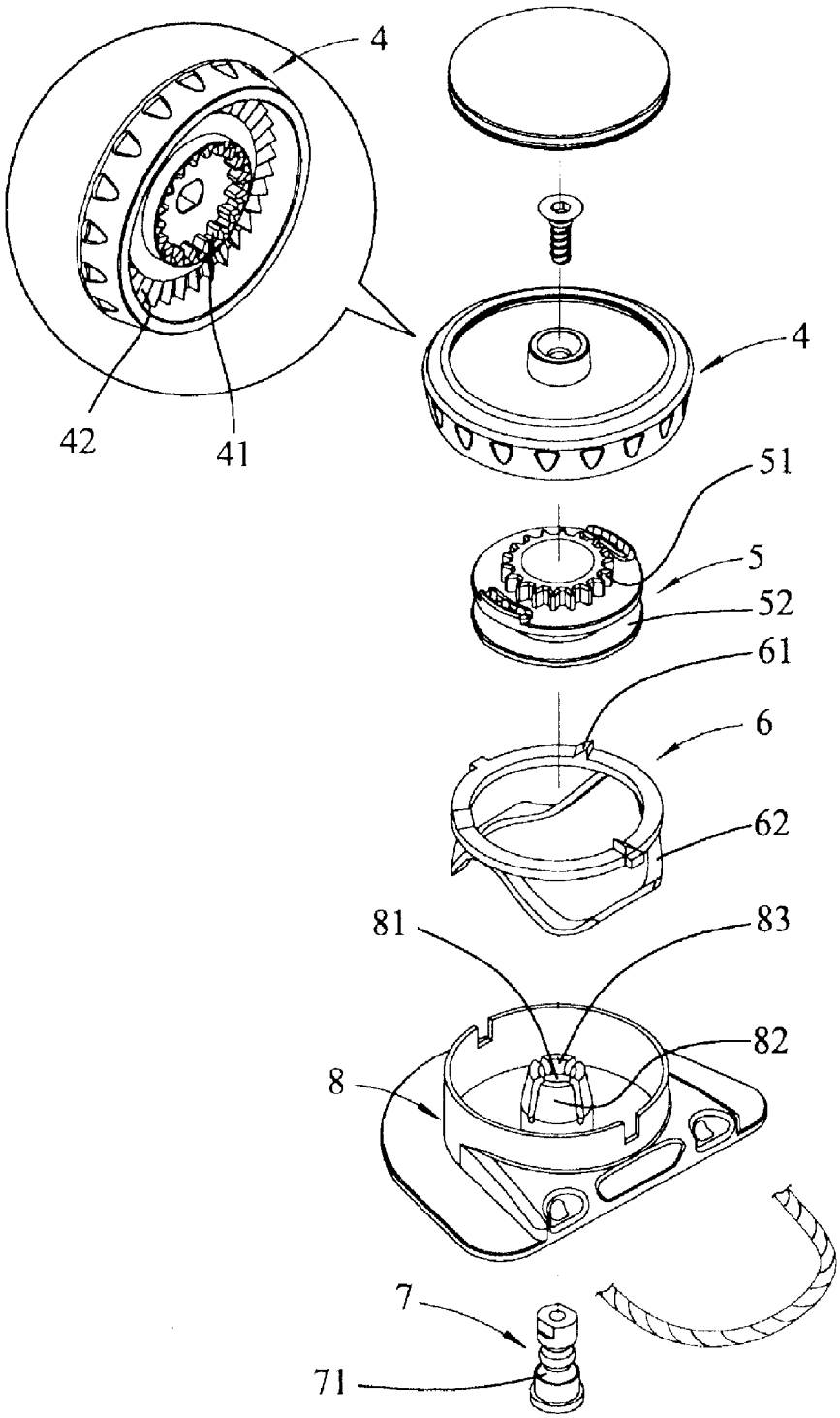
FIG. 7 PRIOR ART
FIG. 7 is an exploded view to show a conventional fastening device.
Figure 8:
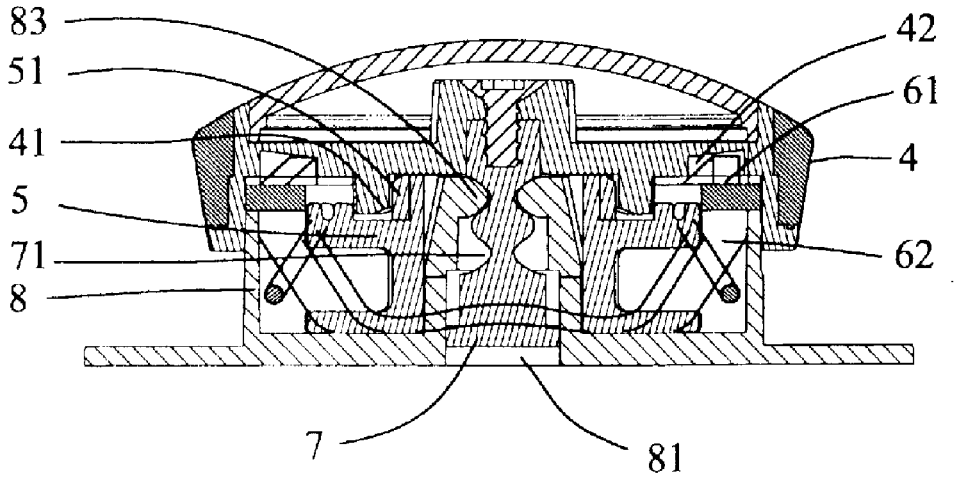
FIG. 8 PRIOR ART
FIG. 8 is a cross sectional view of the conventional fastening device.
Figure 9:
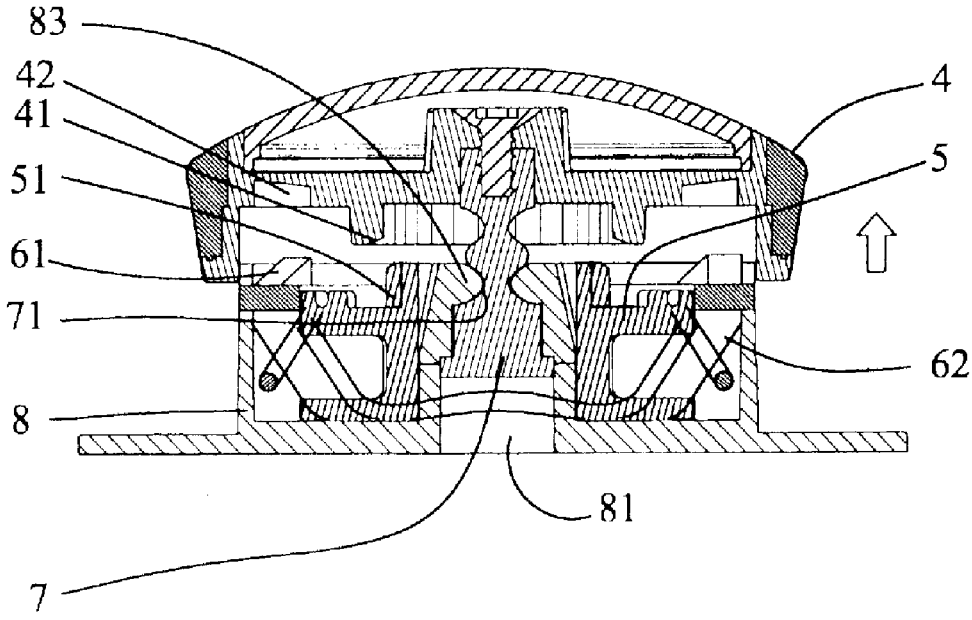
FIG. 9 PRIOR ART
FIG. 9 shows that the cap of the conventional fastening device is pulled upward.

Referring to FIGS. 3 to 6, when rotating the operation ring 21 in the first direction (clockwise), the activation ring 22 is co-rotated with the operation ring 21 because of the connection between the arms 13 and the notches 223, the inclined teeth 232 move over the one-direction teeth 12 so that the driving gear 11 spool 33 to wrap and tighten the shoelace.

When the user feel that the shoelace is too tight, he or she can rotate the cap 1 together with the operation ring 21 in the second direction (counterclockwise, while the cap 1 and the operation ring 21 are not pulled upward) to let the inclined surfaces 241 push the protrusions 222 downward, so that the activation ring 22 moves downward along the arms 13 until the protrusions 222 moves from the end of the inclined surfaces 241. The skirt 221 also presses the snap pieces 233 to let the posts 231 compress the springs 234, the inclined teeth 232 are able to move over the one-direction teeth 12 periodically. When the cap 1 is rotated in the second direction, the spool 33 is rotated in the second direction to steplessly loosen the shoelace by the repeated movement of the activation ring 22 and the engaging member 23.

If the user wants to loosen the shoelace completely, the operation ring 21 is pulled upward to lift the shaft 35, the one-direction teeth 12 are disengaged from the inclined teeth 232, and the driving gear 11 is disengaged from the spool 33, the shoelace is able to be loosened.

Therefore, the stepless fastening device of the present invention can loosen the shoelace when the shoelace is tightened too much by reversely rotating the cap 1 and the operation ring 21. The shaft 35 does not need to be pulled upward and the shoelace can be adjusted to a desired status.

While we have shown and described the embodiment in accordance with the present invention, it should be clear to those skilled in the art that further embodiments may be made without departing from the scope of the present invention.

What is claimed is:

1. A stepless fastening device comprising:

a cap having a driving gear connected to an underside thereof and multiple one-direction teeth located around the driving gear;

an operation unit located beneath the cap and including an operation ring, an activation ring and an engaging member;

the operation ring of the operation unit including multiple pressing blocks located on an underside thereof and each pressing block including an inclined surface;

the activation ring further comprising a skirt, multiple notches and multiple protrusions, the skirt extending from an underside of the activation ring and the multiple notches defined in an outer periphery of the activation ring, the protrusions extending from a top of the activation ring and the pressing blocks contacting the protrusions of the activation ring, the activation ring being located in the operation ring;

a base having a spool which has teeth engaged with the driving gear of the cap, and the operation unit being rotatable in a first direction to rotate the spool in the same direction for tightening a shoelace, the operation unit being rotatable in a second direction to rotate the spool in the same direction for loosening the shoelace.

2. The device as claimed in claim 1, wherein the operation ring is connected to the underside of the cap and pushes the activation ring away from the cap when the operation ring is rotated in the second direction, the engaging member includes inclined teeth and the engaging member pushed by the activation ring so that the inclined teeth are disengaged from the one-direction teeth of the cap.

3. The device as claimed in claim 2, wherein the cap includes multiple arms extending from an outer periphery thereof, the arms of the cap extending through the notches of the activation ring, the operation ring of the operation unit being mounted to the arms.

4. The device as claimed in claim 1, wherein the engaging member includes multiple posts and each post has an inclined tooth on a top thereof, the inclined teeth are engaged with the one-direction teeth of the cap, each of the posts includes a snap piece which extends perpendicularly from the post, the skirt of the activation ring is engaged with the snap pieces.

5. The device as claimed in claim 4, wherein the engaging member is biased by springs which are located in the base and mounted to respective lower ends of the posts.

6. The device as claimed in claim 1, wherein the base includes a top part, a bottom part and a connection part, the top part is connected to the bottom part which is connected to the connection part.

* * * * *